US008740573B2

(12) United States Patent
Delvaux et al.

(10) Patent No.: US 8,740,573 B2
(45) Date of Patent: Jun. 3, 2014

(54) ADAPTOR ASSEMBLY FOR COUPLING TURBINE BLADES TO ROTOR DISKS

(75) Inventors: John McConnell Delvaux, Fountain Inn, SC (US); Andres Jose Garcia-Crespo, Greenville, SC (US); Kilmer Joseph Joyce, Jupiter, FL (US); Allan Randall Tindell, Delray Beach, FL (US)

(73) Assignee: General Electric Company, Schenectady, NY (US)

( * ) Notice: Subject to any disclaimer, the term of this patent is extended or adjusted under 35 U.S.C. 154(b) by 521 days.

(21) Appl. No.: 13/094,176

(22) Filed: Apr. 26, 2011

(65) Prior Publication Data

US 2012/0275920 A1 Nov. 1, 2012

(51) Int. Cl.
*F01D 5/30* (2006.01)

(52) U.S. Cl.
USPC ..... 416/248; 416/214 A; 416/219 R

(58) Field of Classification Search
USPC ..... 416/214 A, 219 R, 220 R, 248
See application file for complete search history.

(56) References Cited

U.S. PATENT DOCUMENTS

| | | | | |
|---|---|---|---|---|
| 1,362,074 | A * | 12/1920 | Baumann | 416/217 |
| 3,471,127 | A * | 10/1969 | Emmerson | 416/95 |
| 4,094,615 | A * | 6/1978 | Glenn | 416/215 |
| 4,111,603 | A * | 9/1978 | Stahl | 416/95 |
| 4,142,836 | A | 3/1979 | Glenn | |
| 4,523,890 | A * | 6/1985 | Thompson | 416/95 |
| 4,854,821 | A * | 8/1989 | Kernon et al. | 416/95 |
| 5,388,962 | A * | 2/1995 | Wygle et al. | 416/95 |
| 8,206,119 | B2 * | 6/2012 | Liotta et al. | 416/220 R |
| 8,573,942 | B2 * | 11/2013 | Strohl et al. | 416/219 R |
| 2005/0265849 | A1 * | 12/2005 | Bobo et al. | 416/220 R |
| 2006/0216152 | A1 * | 9/2006 | Golinkin et al. | 416/220 R |
| 2008/0181767 | A1 * | 7/2008 | Brillert et al. | 415/170.1 |

FOREIGN PATENT DOCUMENTS

| | | | |
|---|---|---|---|
| JP | 59-226202 | * | 12/1984 |
| JP | 6-58102 | * | 3/1994 |

OTHER PUBLICATIONS

Nakayama, Gas Turbine Moving Blade, Mar. 1, 1994, Abstract of JP6-58102.*

Harada, Moving Blade of Turbine, Dec. 19, 1984, Abstract of JP59-226202.*

* cited by examiner

*Primary Examiner* — Ned Landrum
*Assistant Examiner* — Liam McDowell
(74) *Attorney, Agent, or Firm* — Dority & Manning, P.A.

(57) ABSTRACT

An adaptor assembly for coupling a blade root of a turbine blade to a root slot of a rotor disk is disclosed. The adaptor assembly may generally include an adaptor body having a root configured to be received within the root slot. The adaptor body may also define a slot having an open end configured to receive the blade root. The adaptor body may further define a channel. The adaptor assembly may also include a plate having an outwardly extending foot. The foot may be configured to be received within the channel. Additionally, the plate may be configured to cover at least a portion of the open end of the slot when the foot is received within the channel.

18 Claims, 8 Drawing Sheets

ADAPTOR ASSEMBLY FOR COUPLING TURBINE BLADES TO ROTOR DISKS

This invention was made with Government support under Contract No. DE-FC26-05NT42643, awarded by the Department of Energy. The Government has certain rights in the invention.

FIELD OF THE INVENTION

The present subject matter relates generally to gas turbines and, more particularly, to an adaptor assembly for coupling turbine blades to rotor disks.

BACKGROUND OF THE INVENTION

In a gas turbine, hot gases of combustion flow from an annular array of combustors through a transition piece for flow along an annular hot gas path. Turbine stages are typically disposed along the hot gas path such that the hot gases of combustion flow from the transition piece through first-stage nozzles and buckets and through the nozzles and buckets of follow-on turbine stages. Each turbine bucket generally includes an airfoil extending radially outwardly from a substantially planar platform and a blade root extending radially inwardly from the platform. The blade root of each turbine bucket is generally configured to be received within one of a plurality of circumferentially spaced root slots defined in one of the rotor disks of the turbine rotor, with each rotor disk being mounted to the rotor shaft for rotation therewith.

To improve the overall efficiency of a gas turbine, higher operating temperatures are continuously sought. However, as operating temperatures increase, the high temperature durability of the turbine components must correspondingly increase. Thus, efforts have been made to replace the use of metal in the construction of turbine buckets with the use of ceramic materials, such as ceramic matrix materials. As a result, many turbine buckets have been redesigned to accommodate the use of ceramic materials, such as by reshaping the blade root. For example, many turbine buckets now include dovetail-shaped roots as opposed to the fir tree-shaped roots used in metallic buckets. Unfortunately, such reshaping can lead to problems in attaching the blade root to pre-existing rotor disks installed within a gas turbine.

To address such attachment issues, attachment assemblies have been proposed for coupling turbine buckets to rotor disks. However, as of yet, such assemblies have not provided an effective means for axially retaining and/or sealing the turbine bucket within the assembly. Moreover, known assemblies do not include suitable features for damping vibrations between the turbine bucket and the assembly.

Accordingly, an adaptor assembly for coupling a turbine bucket or blade to a rotor disk that provides for effective axial retention and/or sealing of the turbine blade within the assembly and/or provides for effective vibration damping would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter discloses an adaptor assembly for coupling a blade root of a turbine blade to a root slot of a rotor disk. The adaptor assembly may generally include an adaptor body having a root configured to be received within the root slot. The adaptor body may also define a slot having an open end configured to receive the blade root. The adaptor body may further define a channel. The adaptor assembly may also include a plate having an outwardly extending foot. The foot may be configured to be received within the channel. Additionally, the plate may be configured to cover at least a portion of the open end of the slot when the foot is received within the channel.

In another aspect, the present subject matter discloses an adaptor assembly for coupling a blade root of a turbine blade to a root slot of a rotor disk. The adaptor assembly may generally include an adaptor body having a root configured to be received within the root slot. The adaptor body may also define a slot having an open end configured to receive the blade root. The adaptor assembly may also include a plate configured to be coupled to the adaptor body generally adjacent to the open end of the slot. Additionally, at least one of the plate and the adaptor body may include a pocket configured to receive a sealing mechanism.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
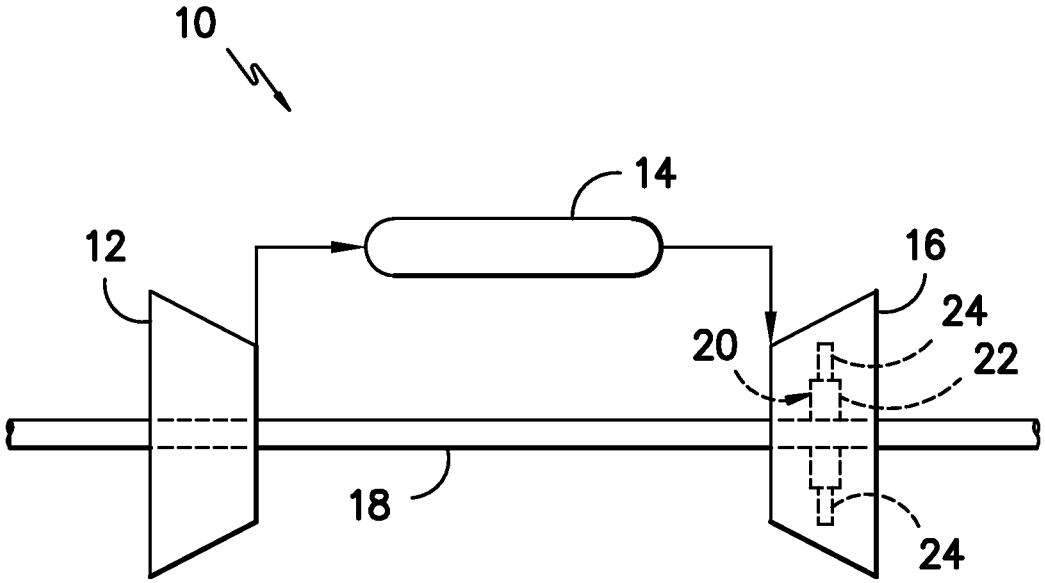
FIG. 1 illustrates a simplified, schematic diagram of one embodiment of a gas turbine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter discloses an adaptor assembly for coupling a turbine blade (e.g., a turbine bucket) to a rotor disk of the turbine rotor. The adaptor assembly may generally include an adaptor body having an adaptor root configured to be coupled to the rotor disk and an adaptor slot configured to axially receive a blade root of the turbine blade. As such, the adaptor assembly may be used in retrofit applications to allow newly designed turbine blades to be coupled to pre-existing rotor disks. Additionally, in several embodiments, the adaptor assembly may include features to provide for axial retention and/or sealing of the blade root within the adaptor slot. For example, the adaptor body may include a retaining wall disposed on one side of the adaptor slot serving as a backstop/seal plate for the blade root. Moreover, the adaptor assembly may also include a cover plate configured to be coupled to the adaptor body on the side of the adaptor slot opposing the retaining wall so as to provide axial retention and/or sealing of the blade root within the adaptor slot.

Further, the adaptor assembly may also include features for providing additional sealing and/or vibration damping between the adaptor assembly and the turbine blade. For example, in several embodiments, the adaptor body and/or cover plate may include one or more pockets configured to receive a sealing mechanism. As such, the adaptor slot may be effectively sealed from the hot gases of combustion flowing past the turbine blade and may also be able to effectively accommodate vibrations of the turbine blade.

Referring now to the drawings, FIG. 1 illustrates a schematic diagram of a gas turbine 10. The gas turbine 10 generally includes a compressor section 12, a plurality of combustors (not shown) disposed within a combustor section 14, and a turbine section 16. Additionally, the system 10 may include a shaft 18 coupled between the compressor section 12 and the turbine section 16. The turbine section 16 may generally include a turbine rotor 20 having a plurality of rotor disks 22 (one of which is shown) and a plurality of turbine blades 24 extending radially outwardly from and being coupled to each rotor disk 22 for rotation therewith. Each rotor disk 22 may, in turn, be coupled to a portion of the shaft 18 extending through the turbine section 16.

During operation of the gas turbine 10, the compressor section 12 supplies compressed air to the combustors of the combustor section 14. Air and fuel are mixed and burned within each combustor and hot gases of combustion flow in a hot gas path from the combustor section 14 to the turbine section 16, wherein energy is extracted from the hot gases by the turbine blades 24. The energy extracted by the turbine blades 24 is used to rotate to the rotor disks 22 which may, in turn, rotate the shaft 18. The mechanical rotational energy may then be used to power the compressor section 12 and generate electricity.

Figure 2:
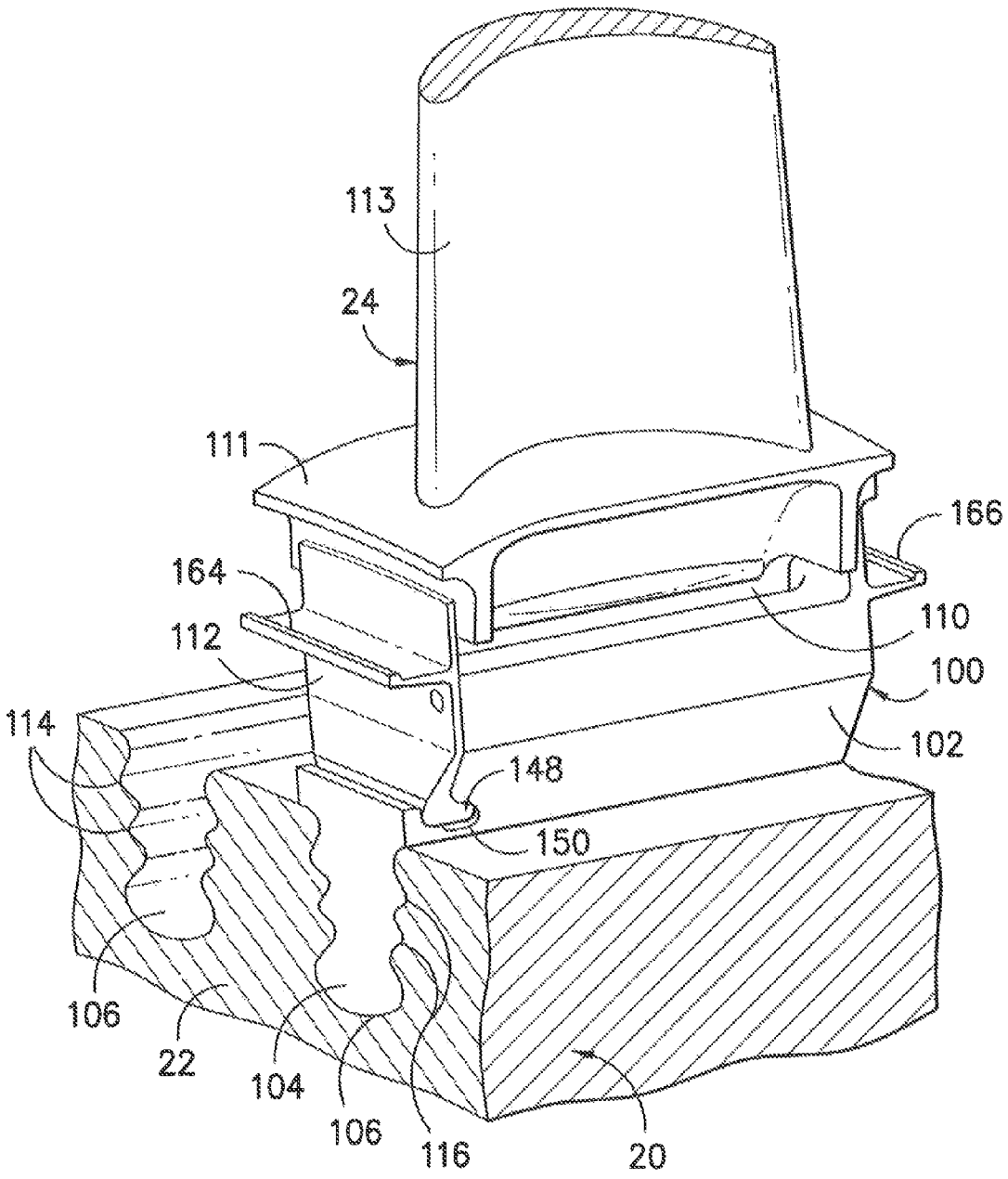
FIG. 2 illustrates a perspective view of one embodiment of an adaptor assembly for coupling a turbine blade to a rotor disk in accordance with aspects of the present subject matter.
Figure 3:
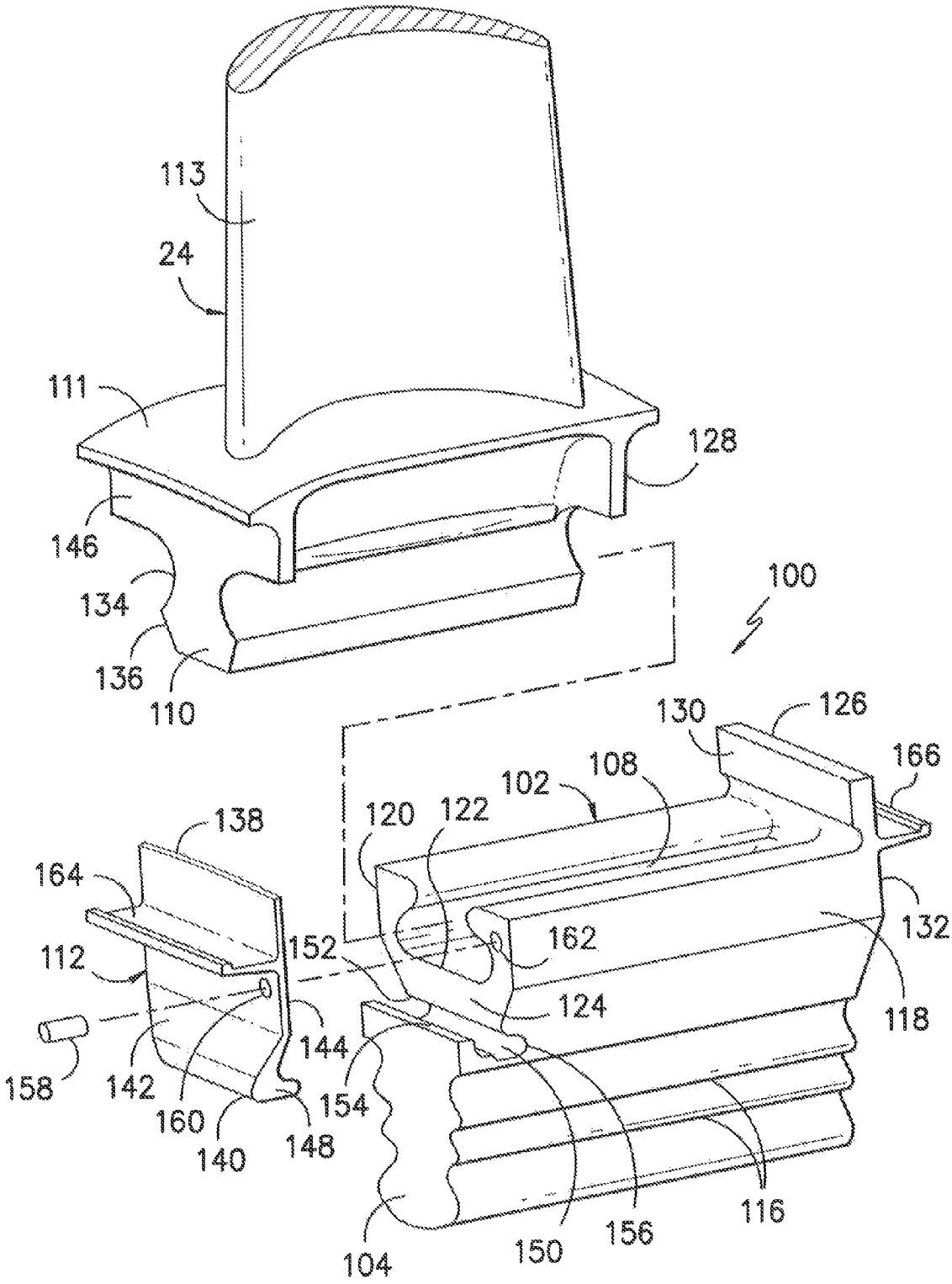
FIG. 3 illustrates an exploded view of the adaptor assembly shown in FIG. 2.
Figure 4:
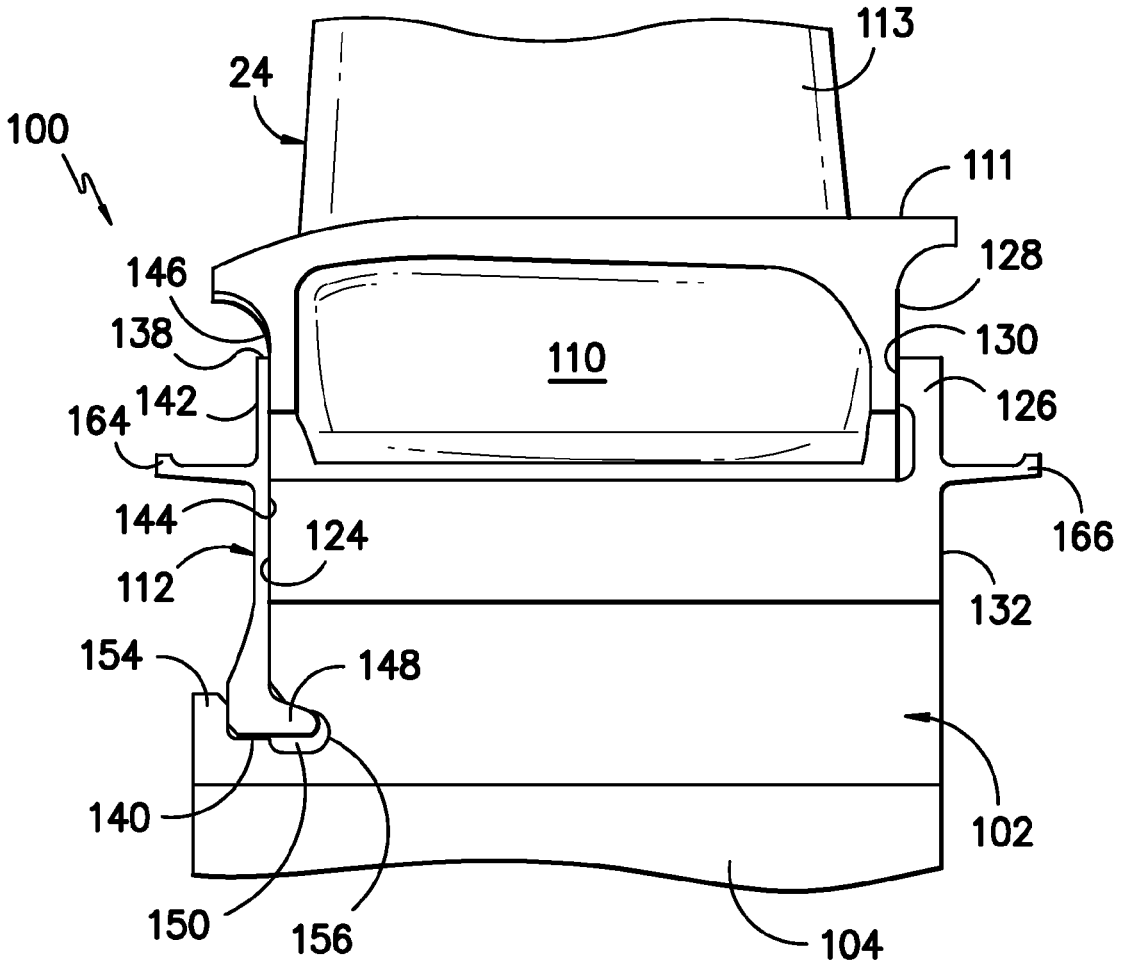
FIG. 4 illustrates a partial, side view of the adaptor assembly shown in FIG. 2.

Referring now to FIGS. 2-4, there are illustrated various views of one embodiment of an adaptor assembly 100 for coupling turbine blades 24 to one of the rotor disks 22 of the turbine rotor 20 in accordance with aspects of the present subject matter. In particular, FIG. 2 illustrates a perspective view of the adaptor assembly 100 coupled between the turbine blade 24 and the rotor disk 22. FIG. 3 illustrates an exploded view of the adaptor assembly 100 and turbine blade 24 shown in FIG. 2. Additionally, FIG. 4 illustrates a partial, side view of the adaptor assembly 100 and the turbine blade 24 shown in FIG. 2, particularly illustrating the turbine blade 24 coupled within the adaptor assembly 100.

As shown, the disclosed adaptor assembly 100 may generally comprise an attachment piece for coupling turbine blades 24 to one of the rotor disks 22 (only a portion of which is shown in FIG. 2) of the turbine rotor 20. In particular, the adaptor assembly 100 may be configured to allow turbine blades 24 having one attachment configuration to be coupled to rotor disks 22 having a different attachment configuration. Thus, in several embodiments, the adaptor assembly 100 may include an adaptor body 102 having attachment features generally corresponding to the attachment features of the turbine blade 24 and the rotor disk 22. For example, the adaptor body 102 may include an adaptor root 104 configured to be received within one of a plurality circumferentially spaced root slots 106 defined in the rotor disk 22 and an adaptor slot 108 configured to receive a blade root 110 of the turbine blade 24. In addition, the adaptor assembly 100 may also include a cover plate 112 configured to be coupled to the adaptor body 102 so as to provide axial retention and/or sealing of the blade root 110 within the adaptor slot 108.

It should be appreciated that the turbine blade 24 described herein may generally be configured similarly to any suitable turbine blade known in the art. Thus, the blade root 110 may be configured to extend radially inwardly from a substantially planar platform 111 defining the radially inner boundary of the hot gases of combustion flowing through the turbine section 16 of the gas turbine 10. Additionally, the turbine blade 24 may include an airfoil 113 extending radially outwardly from the platform 111.

In general, the adaptor root 104 may comprise a radially inwardly extending portion of the adaptor body 102 having a shape and/or profile generally corresponding to the shape and/or profile of the root slots 106 defined in the rotor disk 22. For example, in one embodiment, the root slots 106 of the rotor disk 22 may have a conventional fir tree-type configuration and may include one or more pairs of axially extending grooves 114. In such an embodiment, as shown in FIG. 2, the adaptor root 104 may have a similar fir tree-type configuration and may include one or more pairs of axially extending tangs or lobes 116 generally configured to mate with the grooves 114 defined in the root slots 106. As such, the adaptor root 104 may be configured to be axially inserted within one of the root slots 106, thereby allowing the adaptor body 102 to be coupled to and rotate with the rotor disk 22. It should be appreciated that, in alternative embodiments, the root slots 106 and adaptor root 104 may have any other suitable attachment configuration known in the art. For instance, in one embodiment, the root slots 106 and adaptor root 104 may have corresponding dovetail-type attachment features.

The adaptor slot 108 may generally be defined in the adaptor body 102 radially outwardly from the adaptor root 104, For example, as shown in FIG, 3, the adaptor body 102 may include a first side 118 and a second side 120 extending radially outwardly from the adaptor root 104, with the adaptor slot 108 being defined within the adaptor body 102 between the first and second sides 118, 120. Additionally, the adaptor slot 108 may generally be configured to extend axially within the adaptor body 102 so as to include at least one open end 122 for receiving the blade root 110 of the turbine blade 22. For instance, as shown in FIG. 3, the adaptor slot 108 may originate at an open end 122 defined through a forward face 124 of the adaptor body 102 and may terminate at a retaining wall 126 extending tangentially between the first and second sides 118, 120 of the adaptor body 102. As such, the turbine blade 22 may be coupled to the adaptor body 102 by axially inserting the blade root 110 through the open end 122 of the adaptor slot 108. In addition, the retaining wall 126 may generally serve as a backstop for the turbine blade 24 and, thus, may provide a means for axially retaining and/or sealing the blade root 110 within the adaptor slot 108. Moreover, the retaining wall 126 may also provide a means for indicating the proper axial installation depth of the blade root 110 within the adaptor slot 108. For example, as shown in FIG. 4, an all surface 128 of the blade root 110 may be engaged and/or sealed against a forward surface 130 of the retaining wall 126 when the blade root 110 is properly installed within the adaptor slot 108.

In alternative embodiments, it should be appreciated that the retaining wall 126 may be disposed at the forward face 124 of the adaptor body 102. In such an embodiment, the adaptor slot 108 may defined through an aft face 132 (FIG. 4) of the adaptor body 102 to permit the blade root 110 to be axially inserted into the adaptor slot 108 through the aft face 132. In another embodiment, the adaptor slot 108 may be configured to extending axially through the entire adaptor body 102, such as by extending from the forward face 124 to the aft face 132. As such, the blade root 110 may be axially inserted into the adaptor slot 108 at either end of the adaptor body 102

Additionally, the adaptor slot 108 may generally be configured to have a shape and/or profile corresponding to the shape and/or profile of the blade root 110. For example, as shown in FIG.3, the blade root 110 has a dovetail-type configuration including a narrowed neck 134 and a lobe 136 diverging outwardly from the neck 134, Thus, the adaptor slot 108 may generally have a similar dovetail-type configuration and may define a shape and/or profile configured to receive the neck 134 and diverging lobe 136 of the blade root 110. However, in alternative embodiments, the blade root 110 and adaptor slot 108 may have any other suitable attachment configuration known in the art. For instance, in one embodiment, the blade root 110 and adaptor slot 108 may include corresponding it tree-type attachment features.

Referring still to FIGS. 2-4, as indicated above, the cover plate 112 of the adaptor assembly 100 may generally be configured to be coupled to the adaptor body 102. In particular, the cover plate 112 may be configured to be coupled to the adaptor body 102 at a location generally adjacent to the forward face 124 of the adaptor body 102 such that the cover plate 112 is disposed over and/or covers at least a portion of the open end 122 of the adaptor slot 108. As such, the cover plate 112, in combination with the retaining wall 126, may generally serve to axially retain the blade root 110 within the adaptor slot 108. Additionally, by providing a sealing interface between the cover plate 112 and the forward face 124 of the adaptor body 102, the cover plate 112 may also prevent the hot gases of combustion flowing adjacent to the turbine blade 24 from being ingested into the adaptor slot 108.

It should be appreciated that, in embodiments in which the open end 122 of the adaptor slot 108 is defined through the aft face 132 of the adaptor body 102, the cover plate 112 may generally be configured to be coupled to the adaptor body 102 at the aft face 132. Similarly, in embodiments in which the adaptor slot 108 extends between the forward and aft faces 124, 132 of the adaptor body 102 and, thus, includes two open ends (not shown), cover plates 112 may be disposed at each end of the adaptor slot 108 to provide axial retention and/or sealing of the blade root 110 within the adaptor slot 108.

In general, the cover plate 112 may include a top end 138, a bottom end 140, a front face 142 and a back face 144. As shown, the cover plate 112 may generally be configured to extend radially between the top end 138 and the bottom end 140. Additionally, in several embodiments, the back face 144 of the cover plate 112 may be configured to be engaged and/or sealed against the forward face 124 of the adaptor body 102. For example, as shown in FIG. 4, the back face 144 may be in sealing engagement with the forward face 124 when the cover plate 112 is coupled to the adaptor body 102, thereby providing for axial retention and/or sealing for the blade root 110 at the open end 122 of the adaptor slot 108. Further, in one embodiment, the adaptor slot 108 may be dimensioned or otherwise configured such that, when the aft surface 128 of the blade root 110 is engaged against the retaining wall 126 of the adaptor body 102, a forward surface 146 of the blade root 110 may be disposed substantially flush with the forward face 124. In such an embodiment, a portion of the back face 144 of the cover plate 112 may also be engaged and/or sealed against the forward surface 146 of the blade root 110, thereby providing for further axial retention and/or sealing of the blade root 110 within the adaptor slot 108.

Additionally, in several embodiments, the cover plate 112 may also include an axially extending projection or foot 148 configured to be received and retained within a corresponding channel 150 defined in the adaptor body 102. In general, the foot 148 and the channel 150 may have any suitable configuration such that, when the foot 148 is received within the channel 150, the back face 144 of the cover plate 112 may be engaged and/or sealed against the forward face 124 of the adaptor body 102. Thus, in one embodiment, the channel 150 may be defined in and/or adjacent to the forward face 124, such as by being defined radially inwardly from the open end 122 of the adaptor slot 108 along an inner edge 152 of the forward face 124. Additionally, the channel 150 may be configured to extend axially both forward and aft of the forward face 124. For instance, as shown in FIG. 4, the channel 150 may be configured to extend axially between a radial lip 154 formed in the adaptor body 102 axially forward of the forward face 124 and a rearward surface 156 defined in the adaptor body 102 axially aft of the forward face 124. In such embodiments, the foot 148 may generally be formed along the bottom end 140 of the cover plate 112 and may be configured to project outwardly relative to the back face 144 of the cover plate 112. For example, as shown in FIG. 4, the foot 148 may be configured to project substantially perpendicularly from the back face 144. As such, the foot 148 may extend axially within the channel 150 in the direction of the rearward surface 156 when the back face 144 of the cover plate 112 is engaged and/or sealed against the forward face 124 of the adaptor body 102, thereby allowing the foot 148 to be radially retained within the channel 150 along the inner edge 152 of the forward face 124.

Moreover, the radial lip 154 formed in the adaptor body 102 may generally serve to axially retain the foot 148 within the channel 150. In particular, as shown in FIG. 4, the front face 142 of the cover plate 122 may diverge axially as it extend radially inwardly such that a portion of the cover plate 112 is disposed adjacent to and/or is engaged against the radial lip 154. As such, the radial lip 154 may be prevent the cover plate 112 moving axially away from the forward face 124 of the adaptor body 102, thereby maintaining the foot 148 within the channel 150.

Further, as shown in FIG. 3, the channel 150 may be configured to extend longitudinally from the first side 118 to the second side 120 of the adaptor body 102. Thus, the cover plate 112 may generally be positioned against the forward face 124 of the adaptor body 102 by inserting the foot 148 within the channel 150 at either side 118, 120 of the adaptor body 120 and by tangentially sliding the cover plate 112 into place. However, in other embodiments, the channel 150 may be configured to extend partially between the first and second sides 118, 120 such that the foot 150 may only be inserted into the channel 150 along one of the sides 118, 120 of the adaptor body 102.

Additionally, in a particular embodiment of the present subject matter, the cover plate 112 and the adaptor body 102 may be configured to receive a retaining pin 158 for maintaining the tangential position of the cover plate 112 relative to the adaptor body 102. For example, as shown in FIG. 3, the cover plate 112 may define an opening 160 configured to be radially aligned with a corresponding cavity 162 defined in the adaptor body 102. As such, when the cover plate 122 is coupled to the adaptor body 102, the retaining pin 158 may be axially inserted through the opening 160 and into the cavity 162 in order to provide a tangential retention feature to the adaptor assembly 100.

It should be appreciated that, in alternative embodiments, the cover plate 112 and the adaptor body 102 may generally have any other suitable configuration that allows the cover plate 112 to be coupled to the adaptor body 102 at the open end 122 of the adaptor slot 108. For example, in one embodiment, the foot 148 may be formed in the cover plate 112 at a differing radial location than that shown in FIGS. 2-4, such as by being spaced apart radially from the bottom end 140 of the cover plate 112. In such an embodiment, the channel 150 may also be defined in the adaptor body 102 at a differing radial location, such as by being defined in the forward face 124 of the adaptor body 102 directly below the open end 122 of the adaptor slot 108. In another embodiment, the foot 148 may be configured to project outwardly from both the front face 142 and the back face 144 of the cover plate 112, such as by defining an inverted "T" shape at the bottom end 140 of the cover plate 112. In such an embodiment, the channel 150 may be defined in the adaptor body 102 so as to have a shape or profile generally corresponding to the T-shaped foot 148.

Referring still to FIGS. 2-4, in several embodiments of the present subject matter, the adaptor assembly 100 may include one or more angel wings 164, 166 configured to provide radial sealing between the rotating components coupled to the rotor disk 22 (e.g., the adaptor assembly 100 and/or the turbine blade 24) and the stationary components (not shown) disposed forward and aft of such rotating components so as to prevent hot gas ingestion within the wheel space (not shown) adjacent to the rotor disk 22. For example, as shown in the illustrated embodiment, both the cover plate 112 and the adaptor body 102 may include angel wings 164, 166. Specifically as shown in FIG. 4, a first angel wing 164 may extending axially from the front face 142 of the cover plate 112 and a second angel wing 166 may extend axially from the aft face 132 of the adaptor body 102. In another embodiment, the cover plate 112 and the adaptor body 102 may each include two or more outwardly extending angel wings 164, 166. Alternatively, only one of the cover plate 112 and the adaptor body 102 may include one or more angel wing(s) 164, 166 extending outwardly therefrom.

Figure 5:
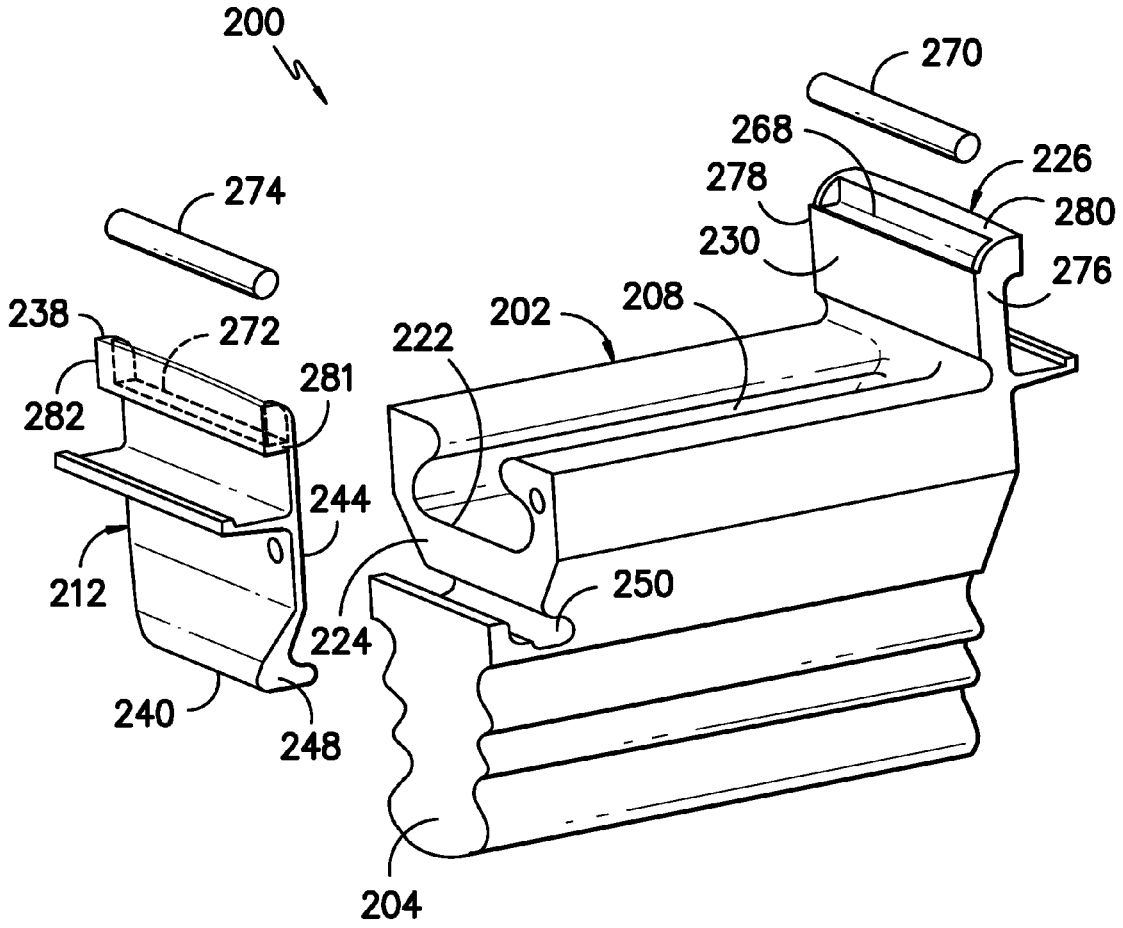
FIG. 5 illustrates an exploded view of another embodiment of an adaptor assembly for coupling a turbine blade to a rotor disk in accordance with aspects of the present subject matter.
Figure 6:
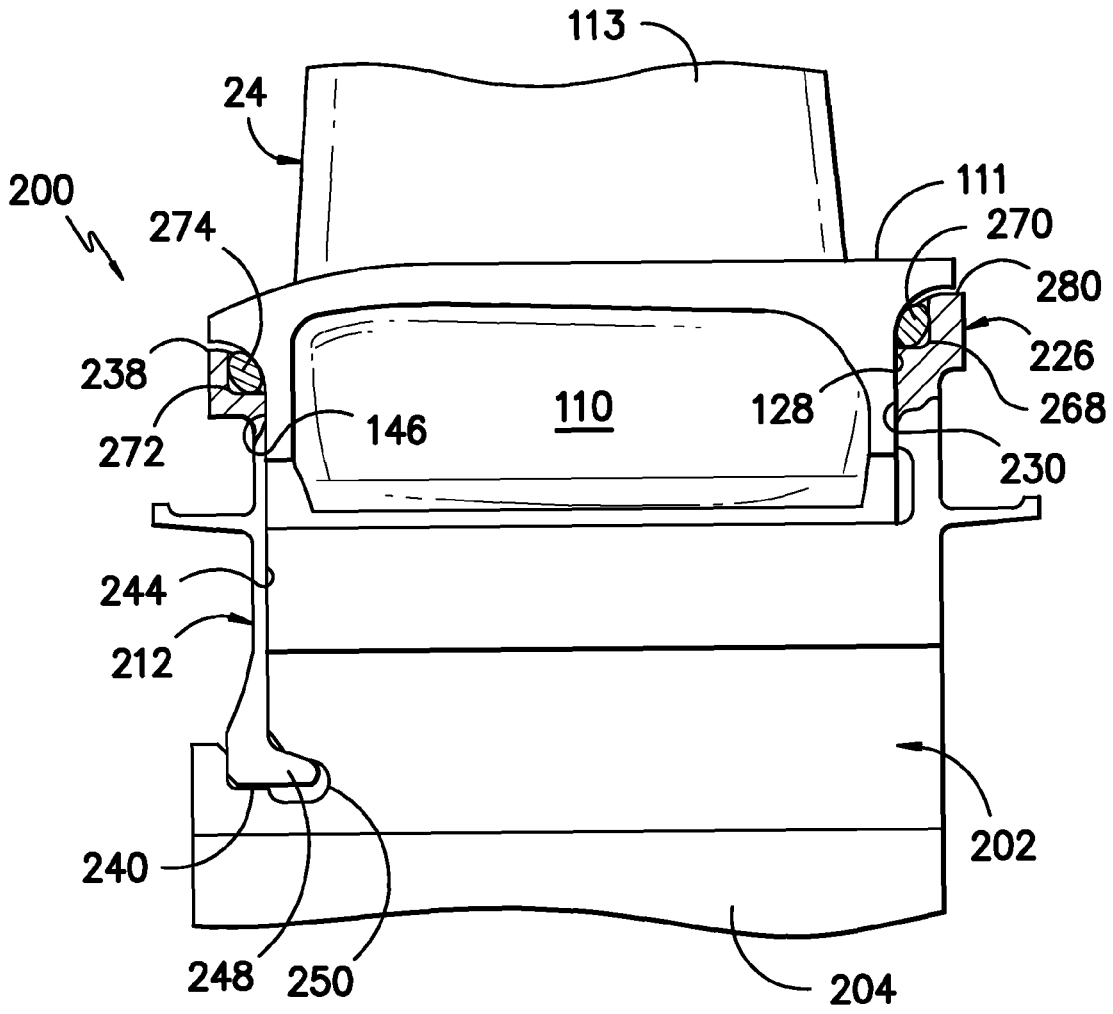
FIG. 6 illustrates a partial, side view of the adaptor assembly shown in FIG. 5.

Referring now to FIGS. 5 and 6, there is illustrated another embodiment of an adaptor assembly 200 suitable for coupling turbine blades 24 to the one of the rotor disks 22 of the turbine rotor 20 in accordance with aspects of the present subject matter. In particular, FIG. 5 illustrates a perspective view of an adaptor body 202 and a cover plate 212 of the adaptor assembly 200. Additionally, FIG. 6 illustrates a partial, side view the adaptor assembly 200, particularly illustrating a turbine blade 24 coupled within the adaptor assembly 200.

In general, the illustrated adaptor body 202 and cover plate 212 may be configured similarly to the adaptor body 102 and cover plate 112 described above with reference to FIGS. 2-4. Thus, the adaptor body 202 may include an adaptor root 204 configured to be received within one of the root slots 106 (FIG. 2) defined in one of the rotor disks 22 of the turbine rotor 20. The adaptor body 202 may also include an adaptor slot 208 configured to receive the blade root 110 of the turbine blade 24. For example, as shown in FIG. 5, the adaptor slot 208 may be defined in adaptor body 202 so as to extend axially between a forward face 224 and a retaining wall 226 of the adaptor body 202. Additionally, the cover plate 212 may be configured to be coupled to the adaptor body 202 at a location generally adjacent to the open end 222 of the adaptor slot 208. For instance, as shown in FIG. 5, the cover plate 212 may extend radially between a top end 238 and a bottom end 240 and may include an axially extending foot 248 formed along the bottom end 240. As such, the foot 248 may be configured to be received within a corresponding channel 250 defined in the adaptor body 202.

However, unlike the embodiments described above, the illustrated cover plate 212 and/or adaptor body 202 may include one or more pockets 268, 272 configured to receive one or more sealing mechanisms 270, 274, As used herein, the term "sealing mechanism" refers to any mechanism and/or device that can be used to provide a seal between two adjacent surfaces and/or any mechanism and/or device that can be used to dampen vibrations between two adjacent components. Thus, suitable sealing mechanisms 270, 274 may include, but are not limited to, damper pins, damper pads, compression seals, brush seals, labyrinth seals, friction seals, face seals and other suitable damping and/or sealing devices.

For example, in several embodiments, a first pocket 268 may be defined in the retaining wall 226 of the adaptor body 202 for receiving a first sealing mechanism 270. As described above, the retaining wall 226 may generally serve as a backstop for the blade root 110 of the turbine blade 24 and, thus, a forward surface 230 (FIG. 5) of the retaining wall 226 may generally be engaged and/or sealed against an aft surface 128 of the blade root 110 when the blade root 110 is inserted axially within the adaptor slot 208. Thus, in one embodiment, the first pocket 268 may be defined in the retaining wall 226 such that the first sealing mechanism 270 may be disposed between the aft surface 128 of the blade root 110 and the retaining wall 226 in order to provide sealing and/or vibration damping between such components. For example, as shown in FIGS. 5 and 6, the first pocket 268 may be defined between a first side 276 and a second side 278 of the retaining wall 226 so as to extend both axially from the forward surface 230 of the retaining wall 226 and radially inwardly from a top end 280 of the retaining wall 226. As such, the first pocket 268 may generally be open at interface between the forward surface 230 and the top end 280 of the retaining wall 226 to allow the first sealing mechanism 270 to be engaged and/or sealed against the aft surface 128 of the blade root 110 when the root 110 is installed within the adaptor slot 208. For instance, as shown in FIG. 6, the top end 280 of the retaining wall 226 may be configured to be disposed generally adjacent to the platform 111 of the turbine blade 24 such that the first sealing mechanism 270 is maintained between the retaining wall 226 and the curved section of the aft surface 128 extending outwardly along the underside of the platform 111.

In alternative embodiments, it should be appreciated that the first pocket 268 may have any other suitable configuration and may be defined in the retaining 226 wall at any other suitable location that allows the first sealing mechanism 270 to be maintained adjacent to the aft surface 128 of the blade root 110. It should also be appreciated that, in addition to the first pocket 268 or as an alternative thereto, one or more pockets (not shown) may be defined at any other suitable location on the adaptor body 202. For example, one or more pockets (not shown) may be defined along the adaptor slot 208 such that one or more sealing mechanisms (not shown) may be retained axially between the adaptor body 202 and a portion of the blade root 110.

Additionally, a second pocket 272 may also be defined at or adjacent to the top end 238 of the cover plate 212 for receiving a second sealing mechanism 274 As shown, the second pocket 272 may generally be configured similarly to the first pocket 270. Specifically, as shown in FIGS. 5 and 6, the second pocket 272 may be defined between a first side 281 and a second side 282 of the cover plate 212 so as to extend both axially from a back face 244 of the cover plate 212 and radially inwardly from the top end 238 of the cover plate 212. As such, the second pocket 272 may generally be open at the interface between the back face 244 and top end 238 of the cover plate 212 to allow the second sealing mechanism 274 to be engaged and/or sealed against the forward surface 146 of the blade root 110 when the cover plate 212 is coupled to the adaptor body 202. For instance, as shown in FIG. 6, the top end 238 of the cover plate 212 may be configured to be disposed generally adjacent to the platform iii of the turbine blade 24 such that the second sealing mechanism 274 is maintained between the cover plate 212 and the curved section of the forward surface 146 extending outwardly along the underside of the platform 111.

In alternative embodiments, it should be appreciated that the second pocket 272 may be defined in the cover plate 212 at any other suitable location that allows the second sealing mechanism 272 to be maintained adjacent to the forward surface 146 of the blade root 110.

It should also be appreciated that, in embodiments in which the cover plate 212 and retaining wall 226 are configured to extend radially outwardly to a location generally adjacent to the platform 111 of the turbine blade 24, it may be desirable for the top ends 238, 280 of the cover plate 212 and the retaining wall 226 to have a shape or profile generally corresponding to the shape or profile of the root surfaces 128, 146 extending proximal to the platform 111. For example, as shown in FIG. 5, the top ends 238, 280 of the cover plate 212 and the retaining wall 226 may be configured to have an actuate or curved profile generally corresponding to the curved profile of the portion of the forward and aft surfaces 128, 146 of the blade root 110 extending outwardly along the underside of the platform 111.

Figure 7:
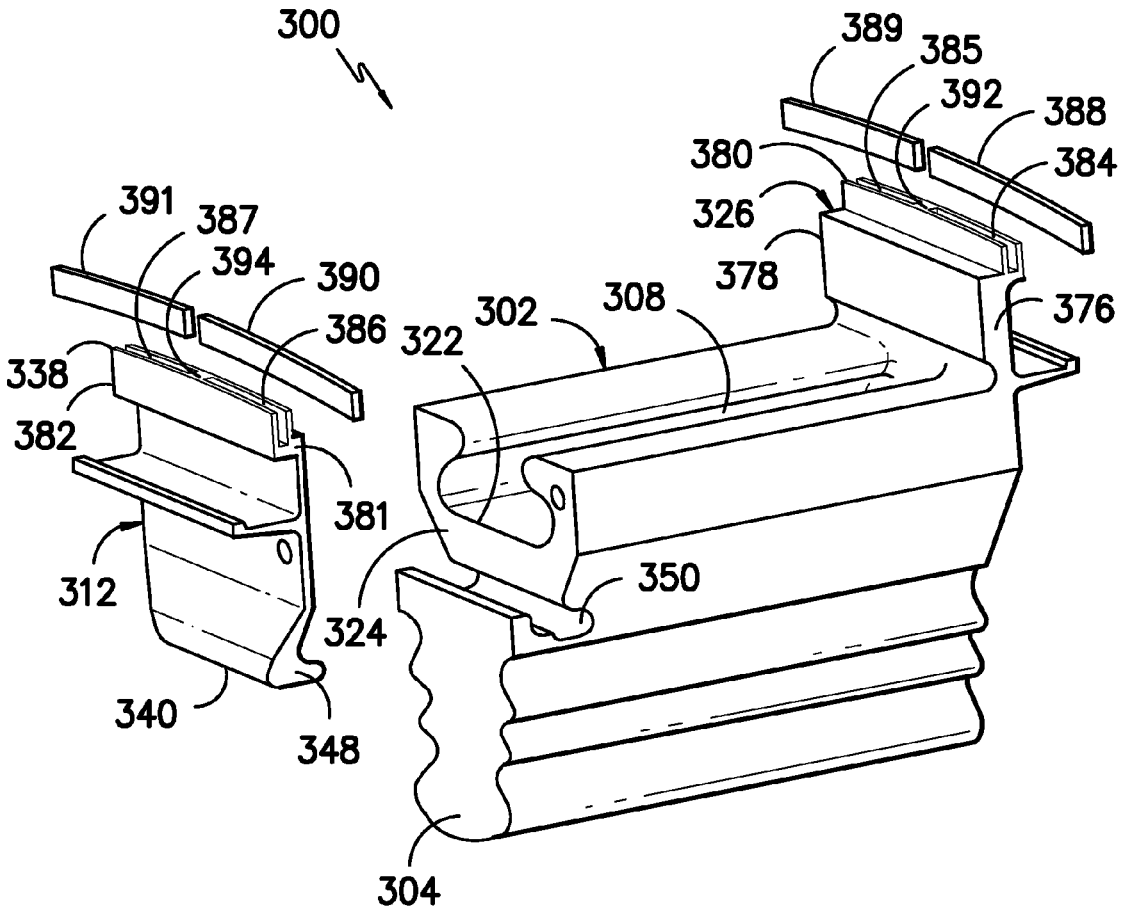
FIG. 7 illustrates an exploded view of another embodiment of an adaptor assembly for coupling a turbine blade to a rotor disk in accordance with aspects of the present subject matter.
Figure 8:
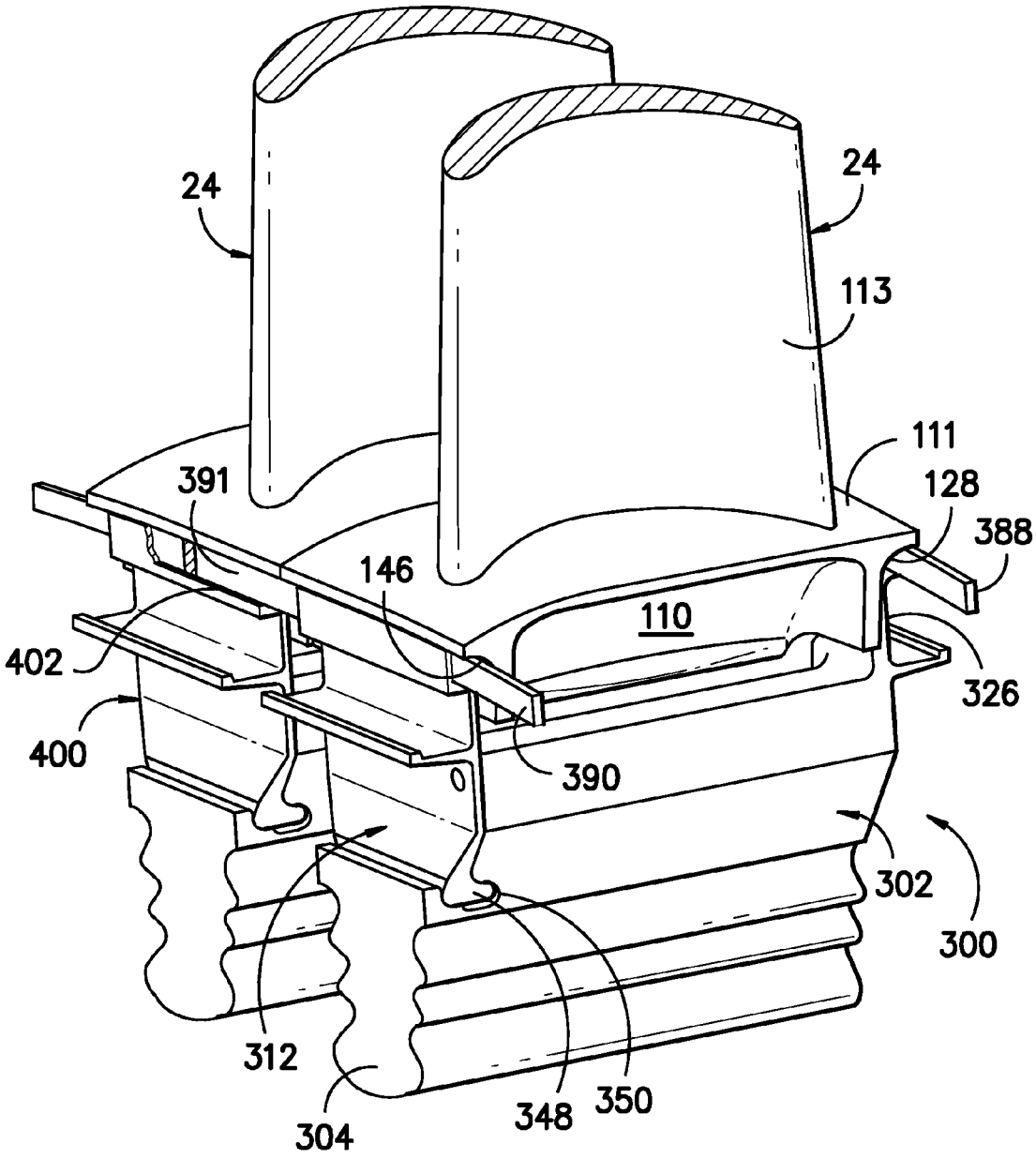
FIG. 8 illustrates a perspective view of the adaptor assembly shown in FIG. 7, particularly illustrating the adaptor assembly positioned adjacent to another adaptor assembly in accordance with aspects of the present subject matter.

Referring now to FIGS. 7 and 8, there is illustrated a further embodiment of an adaptor assembly 300 suitable for coupling turbine blades 24 to the one of the rotor disks 22 of the turbine rotor 20 in accordance with aspects of the present subject matter. In particular, FIG. 7 illustrates a perspective view of an adaptor body 302 and a cover plate 312 of the adaptor assembly 300. Additionally, FIG. 8 illustrates a perspective view the adaptor assembly 300 and an adjacent adaptor assembly 400, particularly illustrating turbine blades 24 coupled within each adaptor assembly 300, 400.

In general, the illustrated adaptor body 302 and cover plate 312 may be configured similarly to the adaptor bodies 102, 202 and cover plates 112, 212 described above with reference to FIGS. 2-6. Thus, the adaptor body 302 may include an adaptor root 304 configured to be received within one of the root slots 106 (FIG. 2) defined in one of the rotor disks 22 of the turbine rotor 20. The adaptor body 302 may also include an adaptor slot 308 configured to receive the blade root 110 of the turbine blade 24. For example, as shown in FIG. 7, the adaptor slot 308 may be defined in adaptor body 302 so as to extend axially between a forward face 324 and a retaining wall 326 of the adaptor body 302. Additionally, the cover plate 312 may be configured to be coupled to the adaptor body 302 at a location generally adjacent to the open end 322 of the adaptor slot 308. For instance, as shown in FIG. 7, the cover plate 312 may extend radially between a top end 338 and a bottom end 340 and may include an axially extending foot 348 formed along the bottom end 340. As such, the foot 348 may be configured to be received within a corresponding channel 350 defined in the adaptor body 302. Moreover, the adaptor body 302 and the cover plate 312 may include one or more pockets 384, 385, 386, 387 configured to receive one or more sealing mechanisms 388, 389, 390, 391.

However, unlike the embodiments descried above with reference to FIGS. 5 and 6, the adaptor body 302. and the cover plate 312 may each include two pockets 384, 385, 386, 387. Specifically, as shown, the retaining wall 326 of the adaptor body 302 may include a first pocket 384 configured to receive a first sealing mechanism 388 and a second pocket 385 configured to receive a second sealing mechanism 389. In general, the first and second pockets 384, 385 may be defined in the retaining wall 326 such that first and second sealing mechanisms 388, 389 may be disposed between the aft surface 128 of the blade root 110 and the retaining wall 326 in order to provide sealing and/or vibration damping between such components. For example, as shown in FIG. 7, the pockets 384, 385 may be defined in the retaining wall 326 so as to extend radially inwardly from a top end 380 of the retaining wall 326. Additionally, a radially extending divider 392 may be formed between the first and second pockets 384, 385 such that the first pocket 384 extends tangentially between a first side 376 of the retaining wall 326 and the divider 392 and the second pocket 385 extends tangentially between the divider 392 and a second side 378 of the retaining wall 326. Thus, the pockets 384, 385 may generally be open along the top end 380 of the retaining wall 326 to allow the sealing mechanisms 388, 389 to extend radially outwardly from the pockets 384, 384. As such, the sealing mechanisms 388, 389 may be engaged and/or sealed against the aft surface 128 of the blade root 110 when the root 110 is installed within the adaptor slot 308. For instance, as shown in FIG. 8, the sealing mechanisms 388, 389 may he engaged and/or sealing against the curved section of the aft surface 128 extending outwardly along the underside of the platform 111 of the turbine blade 24.

Additionally, the cover plate 312 may also include a first pocket 386 configured to receive a first sealing mechanism 390 and a second pocket 387 configured to receive a second sealing mechanism 391. Similar to the pockets 384, 385 defined in the retaining wall 326, the first and second pockets 386, 387 may generally be defined in the cover plate 312 such that first and second sealing mechanisms 390, 391 may be disposed between the forward surface 146 of the blade root 110 and the cover plate 312 in order to provide sealing and/or vibration damping between such components. For example, as shown in FIG. 7, the pockets 386, 387 may be defined in the cover plate 312 so as to extend radially inwardly from a top end 338 of the cover plate 312. Additionally, a radially extending divider 394 may be formed between the first and second pockets 386, 387 such that the first pocket 386 extends tangentially between a first side 381 of the cover plate 312 and the divider 394 and the second pocket 387 extends tangentially between the divider 394 and a second side 382 of the cover plate 312. Thus, the pockets 386, 387 may generally be open along the top end 338 of the cover plate 312 to allow the sealing mechanisms 390, 391 to extend radially outwardly from the pockets 386, 387. As such, the sealing mechanisms 390, 391 may be engaged and/or sealed against the forward surface 146 of the blade root 110 when the cover plate 312 is coupled to the adaptor body 302. For instance, as shown in FIG. 8, the sealing mechanisms 390, 391 may be engaged and/or sealing against the curved section of the forward surface 146 extending outwardly along the underside of the platform 111 of the turbine blade 24.

Moreover, since each pocket 384, 385, 386, 387 is defined through one of the sides 376, 378, 381, 381 of the retaining wall 326 or the cover plate 312, each sealing mechanism 388, 389, 390, 391 may be configured to extend tangentially between its corresponding pocket 384, 385, 386, 387 and an adjacent pocket 402 of an adjacent adaptor assembly 400. For example, as shown in FIG. 8, the second sealing mechanism 391 of the cover plate 312 may be configured to extend tangentially into a corresponding pocket 402 of the adjacent adaptor assembly 400. As such, in addition to be engaged and/or sealed against the turbine blade 24 coupled to the adaptor assembly 300, the sealing mechanism 391 may also be engaged and/or sealed against the adjacent turbine blade 24 coupled to the adjacent adaptor assembly 400, thereby providing for blade-to-blade sealing and/or vibration damping.

It should be appreciated that, in alternative embodiments, the illustrated pockets 384, 385, 386, 387 may have any other suitable configuration and may be defined in the retaining wall 326 and the cover plate 312 at any other suitable locations that permits the sealing mechanisms 388, 389, 390, 391 to be maintained adjacent to one or more of the surfaces 128, 146 of the blade root 110 and also extend tangentially between the adaptor assembly 300 and an adjacent adaptor assembly 400. It should also be appreciated that, in another embodiment, the retaining wall 326 and the cover plate 312 need not include the illustrated dividers 392, 394. For example, the retaining wall 326 may include a single pocket (not shown) defined through its first and second sides 376, 378 and the cover plate 312 may include a single pocket (not shown) defined through its first and second sides 381, 382.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An adaptor assembly for coupling a blade root of a turbine blade to a root slot of a rotor disk, the adaptor assembly comprising:

an adaptor body including a forward face, a retaining wall and first and second sides extending between said forward face and said retaining wall, said adaptor body further including a root configured to be received within the root slot and defining a slot between said first and second sides that extends from said forward face to said retaining wall, said slot having an open end at said forward face configured to receive the blade root, said adaptor body further defining a channel extending both forward and aft of said forward face of said adaptor body; and a plate including an outwardly extending foot, said foot being configured to be received within said channel to extend both forward and aft of said forward face, wherein said plate covers at least a portion of said open end when said foot is received within said channel.

2. The adaptor assembly of claim 1, wherein said open end is defined through said forward face of said adaptor body, said plate being engaged against said forward face when said foot is received within said channel.

3. The adaptor assembly of claim 2, wherein said forward face includes an inner edge disposed radially inwardly from said open end, said channel being defined in said adaptor body along said inner edge.

4. The adaptor assembly of claim 1, wherein said channel is defined in said adaptor body through at least one of said first side or said second side of said adaptor body.

5. The adaptor assembly of claim 1, wherein said foot is configured to extend axially within said channel.

6. The adaptor assembly of claim 1, wherein said plate comprises a back face configured to be engaged against said adaptor body at said open end, said foot extending substantially perpendicularly from said back face.

7. The adaptor assembly of claim 1, further comprising an angel wing extending from at least one of said plate and said adaptor body.

8. The adaptor assembly of claim 1, wherein at least one of said plate and said adaptor body defines a pocket configured to receive a sealing mechanism.

9. An adaptor assembly for coupling a blade root of a turbine blade to a root slot of a rotor disk, the adaptor assembly comprising:

an adaptor body, said adaptor body including a root configured to be received within the root slot and defining a slot having an open end configured to receive the blade root; and a plate configured to be coupled to said adaptor body generally adjacent to said open end, wherein at least one of said plate and said adaptor body includes a pocket configured to receive a sealing mechanism, said pocket extending circumferentially between a first closed end and a second closed end such that the sealing mechanism is retained between the first and second closed ends.

10. The adaptor assembly of claim 9, wherein said plate is configured to be disposed adjacent to a surface of the turbine blade, said pocket being defined in said plate such that the sealing mechanism is retained against the surface.

11. The adaptor assembly of claim 9, wherein said plate extends radially between a top end and a bottom end, said pocket being defined in said plate at said top end.

12. The adaptor assembly of claim 11, further comprising a foot extending outwardly from said plate at said bottom end, said foot being configured to be received within a channel defined in said adaptor body.

13. The adaptor assembly of claim 9, wherein said plate includes a first side and a second side, said first side defining said first closed end of said pocket and said second side defining said second closed end of said pocket.

14. The adaptor assembly of claim 9, wherein said adaptor body includes a retaining wall, said slot extending axially between said open end and said retaining wall.

15. The adaptor assembly of claim 14, wherein said retaining wall is configured to be disposed adjacent to a surface of the turbine blade, said pocket being defined in said retaining wall such that the sealing mechanism is retained against the surface.

16. The adaptor assembly of claim 14, wherein said retaining wall includes a first side and a second side, said first side defining said first closed end of said pocket and said second side defining said second closed end of said pocket.

17. The adaptor assembly of claim 9, further comprising at least two pockets defined in at least one of said adaptor body and said plate, each of said at least two pockets being configured to receive a sealing mechanism.

18. An adaptor assembly for coupling a blade root of a turbine blade to a root slot of a rotor disk, the adaptor assembly comprising:

an adaptor body including a retaining wall having a first side and a second side, said adaptor body further including a root configured to be received within the root slot and defining a slot having an open end configured to receive the blade root, said slot extending axially between said open end and said retaining wall; and a plate configured to be coupled to said adaptor body generally adjacent to said open end, wherein said adaptor body includes a pocket configured to receive a sealing mechanism, said pocket being defined in said retaining wall through at least one of said first and second sides.

* * * * *